US009620836B2

(12) United States Patent
Jolly et al.

(10) Patent No.: US 9,620,836 B2
(45) Date of Patent: Apr. 11, 2017

(54) BANDPASS MICROWAVE FILTER TUNABLE BY A 90 DEGREE ROTATION OF A DIELECTRIC ELEMENT BETWEEN FIRST AND SECOND POSITIONS

(71) Applicants: THALES, Neuilly-sur-seine (FR); CENTRE NATIONAL DE LA RECHERCHE SCIENTIFIQUE, Paris (FR); CENTRE NATIONAL D'ETUDES SPATIALES, Paris (FR)

(72) Inventors: Nicolas Jolly, Bosmie L'Aiguille (FR); Aurelien Perigaud, Panazol (FR); Olivier Tantot, Limoges (FR); Nicolas Delhote, Limoges (FR); Stephane Bila, Verneuil/sur/Vienne (FR); Serge Verdeyme, Aixe/sur/Vienne (FR); Damien Pacaud, Beaumont/sur/Leze (FR); Laetitia Estagerie, Tournefeuille (FR)

(73) Assignees: THALES, Courbevoie (FR); CENTRE NATIONAL DE LA RECHERCHE SCIENTIFIQUE, Paris (FR); CENTRE NATIONAL D'ETUDES SPATIALES, Paris (FR)

( * ) Notice: Subject to any disclaimer, the term of this patent is extended or adjusted under 35 U.S.C. 154(b) by 44 days.

(21) Appl. No.: 14/574,170

(22) Filed: Dec. 17, 2014

(65) Prior Publication Data

US 2015/0180105 A1 Jun. 25, 2015

(30) Foreign Application Priority Data

Dec. 20, 2013 (FR) ..... 13 03029

(51) Int. Cl.
*H01P 1/20* (2006.01)
*H01P 1/208* (2006.01)
(Continued)

(52) U.S. Cl.
CPC ..... *H01P 1/2086* (2013.01); *H01P 1/2084* (2013.01); *H01P 7/105* (2013.01); *H01P 7/06* (2013.01); *H01P 7/10* (2013.01)

(58) Field of Classification Search
CPC .... H01P 1/2082; H01P 1/2084; H01P 1/2086; H01P 7/10; H01P 7/105
(Continued)

(56) References Cited

U.S. PATENT DOCUMENTS 7,352,263 B2 * 4/2008 Pance et al. ..... H01P 1/2084 333/202
7,388,457 B2 * 6/2008 Pance et al. ..... H01P 1/2084 333/202
(Continued)

FOREIGN PATENT DOCUMENTS

DE 4241027 A1 6/1994
EP 1575118 A1 9/2005
(Continued)

*Primary Examiner* — Benny Lee
(74) *Attorney, Agent, or Firm* — Baker & Hostetler LLP

(57) ABSTRACT

A frequency tunable microwave bandpass filter comprises a resonator, including: a cavity with conducting wall substantially cylindrical with axis Z having height H, and partially closed at both ends; and a dielectric element inside the cavity. The resonator resonates at two perpendicular polarizations having distributions of electromagnetic field in the cavity deduced from eachother by 90° rotation. The element rotates about an axis substantially perpendicular to axis Z, between a first and second position. The element comprises a first end wherein: in a first position the element is disposed substantially in a plane perpendicular to axis Z and the center of the first end is disposed at a height in the cavity corresponding substantially to an electric field minimum; and in a second position the element is substantially parallel
(Continued)

to Z and the first end is disposed in a plane corresponding to an electric field maximum within +/−30%.

17 Claims, 12 Drawing Sheets

(51) Int. Cl.
*H01P 7/10* (2006.01)
*H01P 7/06* (2006.01)

(58) Field of Classification Search
USPC ..... 333/202, 235
See application file for complete search history.

(56) References Cited

U.S. PATENT DOCUMENTS

2008/0272860 A1* 11/2008 Pance ..... H01P 1/2084 333/202
2010/0090785 A1* 4/2010 Panariello et al. ..... H01P 7/10 333/209
2013/0328644 A1* 12/2013 Snyder et al. ..... H01P 1/219 333/202
2014/0132370 A1 5/2014 Perigaud et al.

FOREIGN PATENT DOCUMENTS

EP 2448060 A1 6/2010
EP 2690702 A1 1/2014

* cited by examiner

N=1

N=2

N=3

N=1

N=2

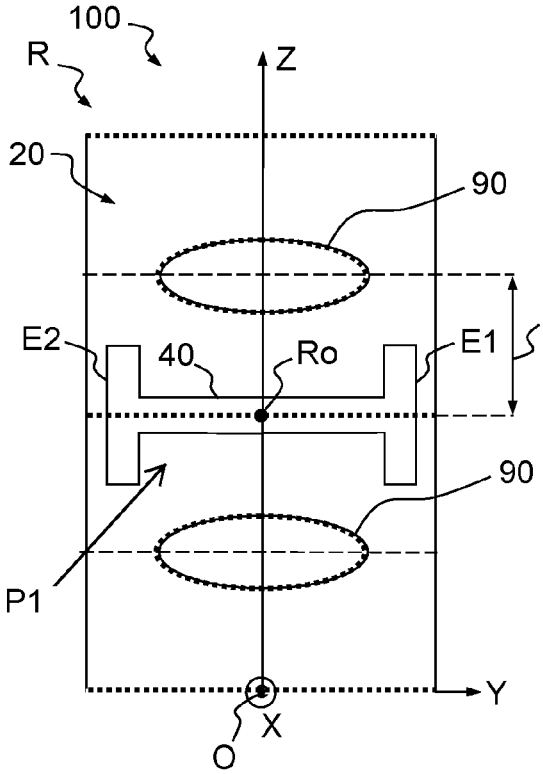
FIG.10a
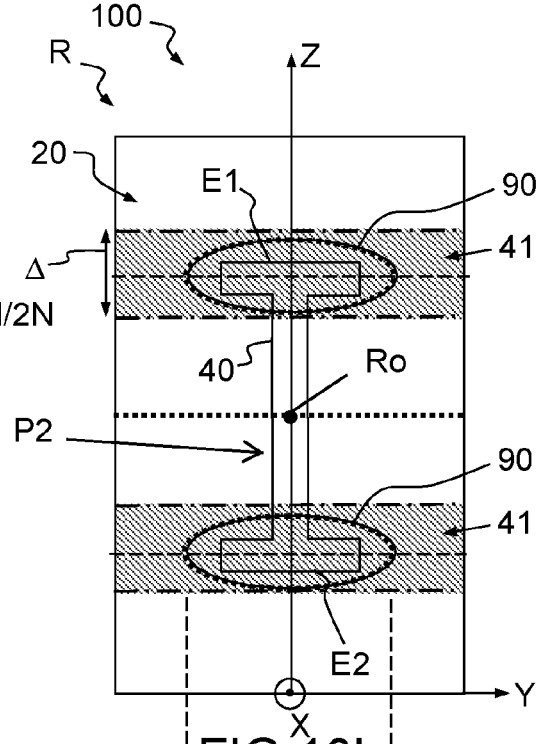
FIG.10b
FIG.11a
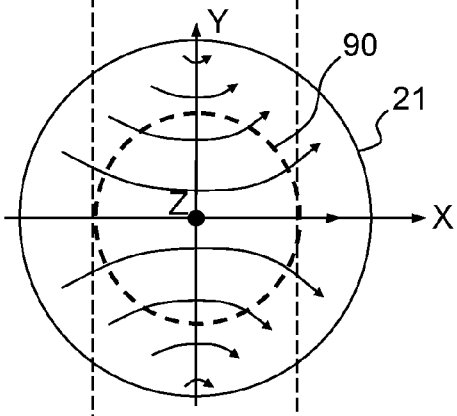
FIG.11b
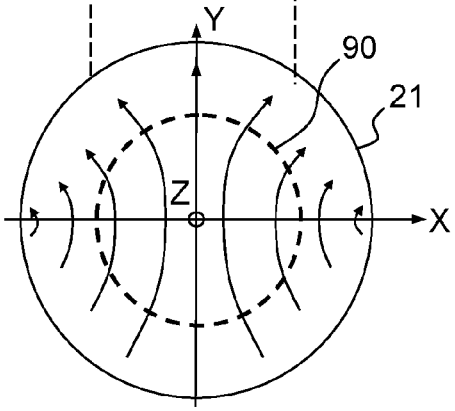

BANDPASS MICROWAVE FILTER TUNABLE BY A 90 DEGREE ROTATION OF A DIELECTRIC ELEMENT BETWEEN FIRST AND SECOND POSITIONS

CROSS-REFERENCE TO RELATED APPLICATION

This application claims priority to foreign French patent application No. FR 1303029, filed on Dec. 20, 2013, the disclosure of which is incorporated by reference in its entirety.

FIELD OF THE INVENTION

The present invention relates to the field of frequency-type filters in the microwave region, typically for frequencies lying between 1 GHz to 30 GHz. More particularly the present invention relates to frequency-tunable bandpass filters.

BACKGROUND

The processing of a microwave-frequency wave, for example received by a satellite, requires the development of specific components, allowing propagation, amplification, and filtering of this wave.

For example a microwave-frequency wave received by a satellite must be amplified before being returned to the ground. This amplification is possible only by separating the set of frequencies received into channels, each corresponding to a given frequency band. Amplification is then carried out channel by channel. The separation of the channels requires the development of bandpass filters.

The development of satellites and the increased complexity of the signal processing to be performed, for example reconfiguration of the channels in flight, has led to the necessity to implement frequency-tunable bandpass filters, that is to say filters for which it is possible to adjust the central filtering frequency customarily referred to as the filter tuning frequency.

One of the known technologies of bandpass filters tunable in the microwave region is the use of passive semi-conducting components, such as PIN diodes, continuously variable capacitors or capacitive switches. Another technology is the use of MEMS (for micro electromechanical systems) of ohmic or capacitive type.

These technologies are complex, inefficient in terms of electrical energy and not very reliable. These solutions are also limited at the level of the signal power processed. Moreover a consequence of frequency tunability is an appreciable degradation in the performance of the filter, such as its quality factor Q. Finally, the RF losses (band achieved, "Return Loss", insertion losses etc. . . . ) are degraded by the change of frequency.

Furthermore, the technology of filters based on dielectric elements is known in the art. The use of dielectric elements makes it possible to produce non-tunable bandpass filters.

These filters typically comprise an at least partially closed cavity, comprising a conducting wall (typically metallic for example made of aluminium or INVAR™, or other similar alloys) in which is disposed a dielectric element, typically of round or square shape (the dielectric material is typically zirconia, alumina or barium magnesium tantalate (BMT)).

An input excitation means introduces the wave into the cavity (for example a coaxial cable terminated by an electrical probe or a waveguide coupled by an iris) and an output excitation means of like nature makes it possible for the cavity to output the wave.

A bandpass filter allows the propagation of a wave over a certain frequency span and attenuates this wave for the other frequencies. A passband and a central frequency of the filter are thus defined. For frequencies around its central frequency, a bandpass filter has high transmission and low reflection.

The passband of the filter is characterized in various ways according to the nature of the filter.

The parameter S is a parameter which expresses the performance of the filter in terms of reflection and transmission. S11, or S22, corresponds to a measure of reflection and S12, or S21, to a measure of transmission.

A filter carries out a filtering function. This filtering function can generally be approximated via mathematical models (Chebychev functions, Bessel functions, etc.). These filtering functions are generally based on ratios of polynomials.

For a filter carrying out a filtering function of Chebychev or generalized Chebychev type, the passband of the filter is determined at equi-ripple of S11 (or S22), for example at 15 dB or 20 dB reduction in reflection with respect to its out-of-band level. For a filter carrying out a function of Bessel type, the band is taken at −3 dB (when S21 crosses S11 if the filter has negligible losses).

A filter typically comprises at least one resonator comprising the metallic cavity and the dielectric element. A mode of resonance of the filter corresponds to a particular distribution of the electromagnetic field which is excited at a particular frequency.

In order to increase filter selectivity, that is to say the capacity of the filter to attenuate the signal outside of the passband, these filters can be composed of a plurality of mutually coupled resonators.

The central frequency and the passband of the filter depend both on the geometry of the cavities and dielectric elements, as well as the mutual coupling of the resonators as well as couplings with the filter input and output excitation means. Coupling means are for example openings or slots referred to as irises, electrical or magnetic probes or microwave lines.

The filter allows through a signal whose frequency lies in the passband, but the signal is nonetheless attenuated by the filter losses.

The tuning of the filter making it possible to obtain a transmission maximum for a given frequency band is very challenging and depends on the whole set of parameters of the filter. It is moreover dependent on the temperature.

In order to perform an adjustment of the filter so as to obtain a precise central frequency of the filter, the resonant frequencies of the resonators of the filter can be very slightly modified with the aid of metallic screws, but this method performed in an empirical manner is very time consuming and allows limited frequency tunability, typically of the order of a few %. In this case, the objective is not tunability but the obtaining of a precise value of the central frequency, and it is desired to obtain reduced sensitivity of the frequency of each resonator in relation to the depth of the screw.

The circular or square symmetry of the resonators simplifies the design of the filter.

Depending on its geometry, generally a resonator has one or more resonant modes each characterized by a particular (distinctive) distribution of the electromagnetic field giving rise to a resonance of the microwave-frequency wave in the structure at a particular frequency. For example, TE (for Transverse Electric or H) or TM (for Transverse Magnetic or E) modes of resonance having a certain numbers of energy maxima labelled by indices, may be excited in the resonator at various frequencies. FIG. 1 illustrates, by way of example, the resonant frequencies (f) of the various modes for an empty circular cavity as a function of the dimensions of the cavity (diameter D and height H). FIG. 1 illustrates the square of the resonance frequency f multiplied by the diameter D divided by $10^4$, $(f.D/10^4)^2$ as a function of the square of the diameter D of the cavity divided by the height H of the cavity, $(D/H)^2$ for different modes TE and TM defined by the numbers of maxima labelled by three subscripts, for example, $TE_{111}$, $TE_{011}$, $TE_{212}$, $TM_{110}$, and $TM_{011}$, etc.

To optimize the compactness of the filters, resonator filters operating on several modes (typically 2 or 3) are known in the art. In particular, filters operating according to a dual mode ("dual mode filter") are known. These modes have two perpendicular polarizations Px and Py having a distinctive and specific distribution of the electromagnetic field in the cavity: the distributions of the electromagnetic fields corresponding to the two polarizations are orthogonal and the distributions corresponding to the two polarizations Px and Py are deduced or obtained from one another by a rotation of 90° about an axis of symmetry of the resonator.

If the symmetry of the resonator is perfect, the two orthogonal polarizations possess the same resonant frequency and are not coupled. Coupling between polarizations is obtained by breaking the symmetry, for example by introducing a discontinuity (perturbation) at 45° to the polarization axes Px and Py, typically with the aid of metallic screws.

Moreover, the resonant frequencies can be tuned (optionally to different frequencies) by introducing discontinuities (perturbations) into the polarization axes Px and Py.

Thus the two polarizations Px and Py of a dual mode can resonate according to one and the same frequency (symmetry in relation to the polarization axes) or according to two slightly different frequencies (dissymmetry in relation to the polarization axes).

The dual modes thus make it possible to produce two electromagnetic resonances in a single resonant element. Several modes possessing these particular field distributions can be used. For example the dual modes TE11n (H11n) are extensively used in cavity filters since they culminate in a good compromise between a large quality factor (the compromise being more with an increasing value of the index n, n being an integer), reduced bulk (reduced by a factor of about 2 by employing dual modes) and significant frequency isolation with respect to the other resonant modes (that one does not desire to couple to ensure proper operation of the filter).

SUMMARY OF THE INVENTION

The aim of the present invention is to produce filters of cavity type with dielectric elements, which are compact, tunable in terms of central frequency, and do not have the aforementioned drawbacks (quality factor and RF losses degraded through tunability, poor power withstanding capability, etc.).

For this purpose the subject of the invention is a bandpass filter for microwave-frequency wave, the bandpass filter being frequency tunable, comprising at least one resonator, each resonator comprising:

a cavity having a conducting wall substantially cylindrical in relation to an axis Z having a height H, a position z along the axis Z being labelled by an abscissa z lying between 0 and H, and being at least partially closed at both ends and, at least one dielectric element disposed inside the cavity, the resonator resonating according to a mode for which two perpendicular polarizations respectively have distributions of the electromagnetic field in the cavity that are deduced from one another by a rotation of 90°, the mode having in the cavity N maxima and N+1 minima of electric field which are situated substantially in a plane perpendicular to the axis Z, the two ends of the cylinder respectively at the abscissae z=0 and z=H corresponding to electric field minima, successive minima and maxima being spaced apart by a separation distance H/2N, characterized in that the bandpass filter comprises:

means of rotation adapted for setting the element into rotation in relation to an axis of rotation Ro substantially perpendicular to the axis Z, between at least a first and a second position, the element comprising at least one first end such that:

in a first position the element is disposed substantially in a plane perpendicular to the axis Z and the centre of the first end is disposed at a height in the cavity corresponding substantially to a minimum of the electric field, in a second position the element is substantially parallel to Z and the first end is disposed in a plane corresponding to an electric field maximum to within +/−30%.

Preferably, the dielectric element has a central part of elongate shape and a first end having a greater cross-section than a cross-section of the central part.

Preferably, the dielectric element in the second position has a shape such that the volume traversed by a polarization is substantially identical to the volume traversed by the orthogonal polarization.

Preferably, the dielectric element in the second position has a shape such that the shape is invariant under rotation of 90° about the axis Z.

According to one embodiment, the shape of the element comprises two orthogonal symmetry planes, a symmetry plane coinciding with a plane comprising a polarization axis and the axis Z, when the element is in the second position.

According to one embodiment, the element comprises a second end such that:

in the first position the centre of the second end is disposed at a height in the cavity corresponding substantially to a minimum of the electric field, in the second position the second end is disposed in a plane corresponding to an electric field maximum to within +/−30%.

Preferably, the substantially cylindrical wall has a director curve (i.e., a base of the substantially cylindrical wall) chosen from among a circle and a square.

Preferably, the angle of rotation in relation to the axis of rotation Ro between the first position and the second position is substantially equal to 90°.

Preferably, the axis of rotation Ro is concurrent with the axis Z.

Preferably, the axis of rotation Ro is situated at an abscissa z corresponding to an electric field minimum.

According to one embodiment, the means of rotation comprise a rod along the axis of rotation Ro rigidly attached to the element and comprising a dielectric material.

Preferably, N=2.

According to one embodiment the filter according to the invention comprises a plurality of resonators and coupling means adapted for coupling together two consecutive resonators.

As a variant, the filter according to the invention furthermore comprises linking means adapted for equalizing the respective rotations of the resonator means of rotation.

Preferably, the linking means comprise the rod rigidly attached to a plurality of elements disposed along the rod.

According to one embodiment, the filter according to the invention furthermore comprises additional dielectric elements disposed inside the coupling means and rigidly attached to the linking means.

According to another aspect, the subject of the invention is a microwave circuit comprising at least one filter according to the invention.

BRIEF DESCRIPTION OF THE DRAWINGS

Other characteristics, aims and advantages of the present invention will become apparent on reading the detailed description which will follow and with regard to the appended drawings given by way of nonlimiting examples where like elements/features are denoted by the same reference numbers, and in which:

FIGS. 10*a*-10*b* describe a variant of a filter according to the invention, FIG. 10*a* in position P1 and FIG. 10*b* in position P2.

FIGS. 11*a*-11*b* illustrate a view from above of the electric field showing diagrammatically the variation of the electric field in section in the vicinity of a maximum, FIG. 11*a* for the polarization Px and FIG. 11*b* for the polarization Py.

DETAILED DESCRIPTION OF THE INVENTION

The invention consists in producing a bandpass filter tunable in terms of central frequency of "dual mode" type on the basis of a rotation of at least one dielectric element in a component resonator R of the filter.

The filter operates in a dual mode ("dual mode filter"), thereby signifying that the resonator resonates in two perpendicular polarizations referred to as Px and Py which respectively have distributions of the electromagnetic field in the cavity 20 that are deduced or obtained from one another by a rotation of 90°.

The two polarizations can resonate at the same frequency or at slightly different frequencies. In the latter case the frequency response of the filter is dissymmetric.

Moreover, the symmetry of the mode is altered to couple the two polarizations.

Figure 1:
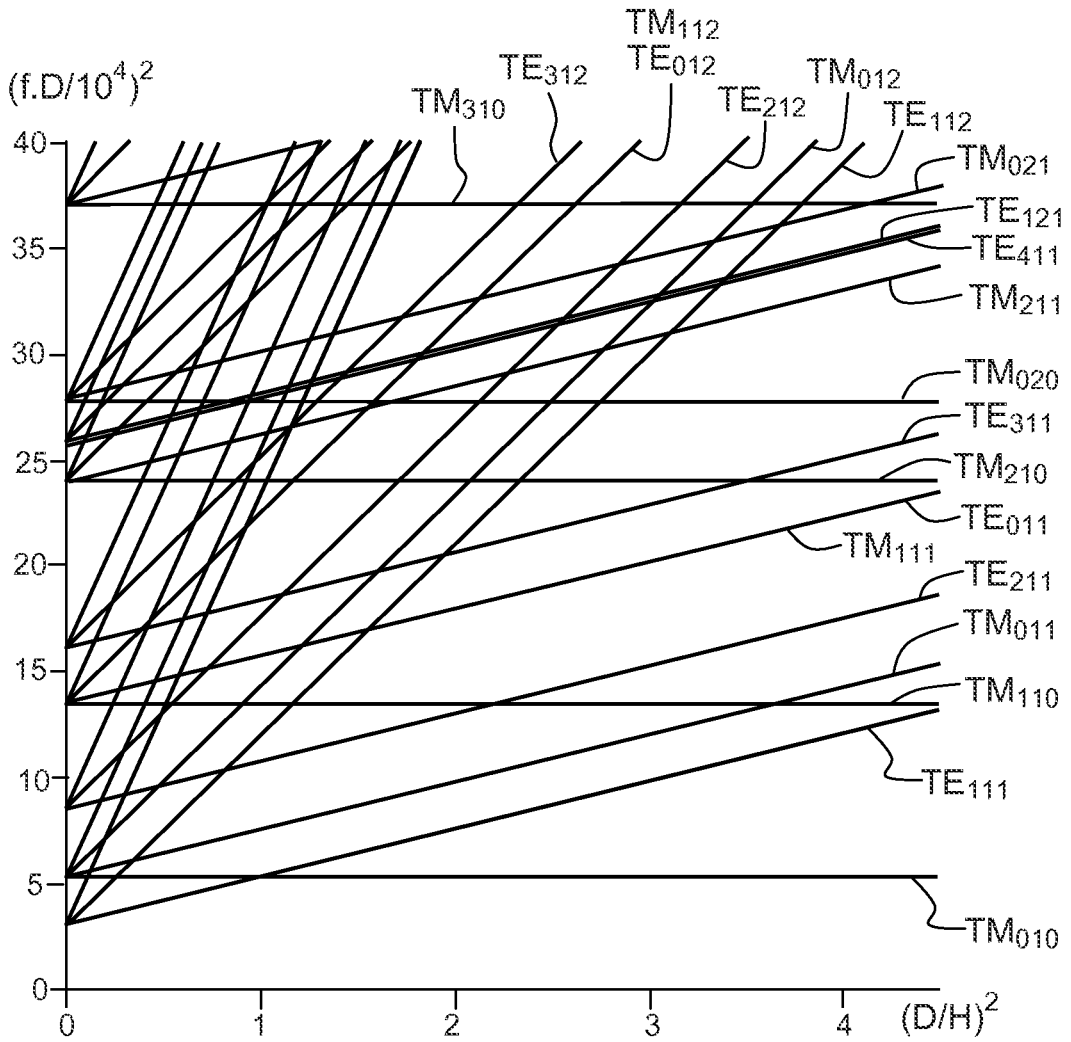
FIG. 1 illustrates the modes of resonance of an empty circular cavity.
Figure 2A:
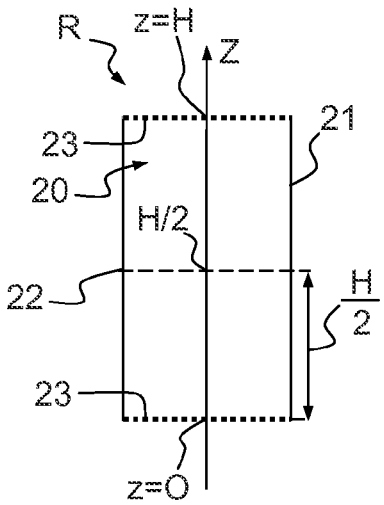
FIGS. 2*a*-2*c* illustrate properties distinctive of filter cavities according to the invention.
Figure 2B:
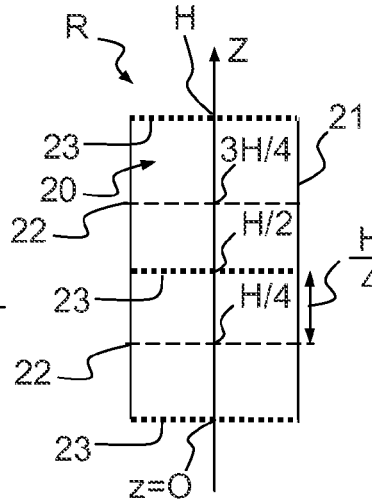
Figure 2C:
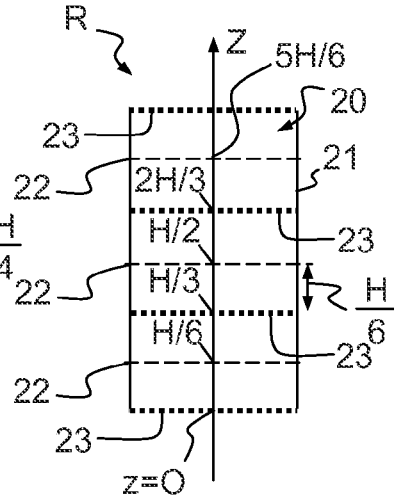

Each resonator R comprises a cavity 20 having a conducting wall 21, typically metallic, substantially cylindrical along an axis Z, and at least one dielectric element disposed inside the cavity as shown in FIGS. 2*a*, 2*b*, and 2*c*. The cylindrical wall preferably has a director curve (a base) equal to a circle or a square.

We shall firstly describe certain properties of cavities according to the invention which are illustrated in FIGS. 2*a*, 2*b*, and 2*c*, while disregarding the dielectric element disposed in the interior, not represented in FIGS. 2*a*, 2*b*, and 2*c*. FIGS. 2*a*, 2*b*, and 2*c* describe three examples of cavities according to a transverse cut through the filter according to the invention in a plane comprising the axis Z.

The cavity 20 has a height H (FIG. 2*b*), and a position along the axis Z is labelled by an abscissa z lying between 0 and H. The cavity 20 is at least partially closed at both ends. For a coupling through the bottom (at z=0), both ends (z=0 and z=H) of the cavity have input and output coupling elements (not shown).

The distribution of the electric field along the axis Z of a dual mode according to the invention resonating in the cavity 20 has particular properties. It is referred to as the mode $H_{11N}$ and has N electric field maxima 22, symbolized by a long-dashed line in FIGS. 2*a*, 2*b*, and 2*c*, and N+1 electric field minima 23 symbolized by a short dashed line in FIGS. 2*a*, 2*b*, and 2*c*. These maxima and minima lie substantially in a plane perpendicular to the axis Z. The cylinder's two ends, respectively at the abscissae z=0 and z=H, consisting of electrically conducting, for example metallic, material necessarily correspond to electric field minima. Moreover, as shown for example in FIGS. 4*b* and 5*a*, a successive minimum and maximum are spaced apart by a separation distance H/2N, where N=1, 2, 3, . . . .

FIG. 2*a* illustrates the distribution of the minima and maxima of fields for a cavity resonating according to the mode N=1 ($H_{111}$), which therefore has 1 field maximum and 2 field minima, here just the two ends. The maximum is situated at an abscissa z=H/2. A successive minimum and maximum are spaced apart by a separation distance H/2.

FIG. 2*b* illustrates the distribution of the minima and maxima of fields for a cavity resonating according to the mode N=2 ($H_{112}$), which therefore has 2 field maxima and 3 field minima. Away from the ends, the third minimum is situated at an abscissa H/2, and the 2 maxima at abscissae H/4, 3H/4 respectively. A successive minimum and maximum are spaced apart by a separation distance H/4.

FIG. 2*c* illustrates the distribution of the minima and maxima of fields for a cavity resonating according to the mode N=3 ($H_{113}$), which therefore has 3 field maxima and 4 field minima. Away from the ends, the other two minima are situated at the abscissae H/3 and 2H/3, and the 3 maxima at the abscissae H/6, H/2 and 5H/6 respectively. A successive minimum and maximum are spaced apart by a separation distance H/6.

Figure 3A:
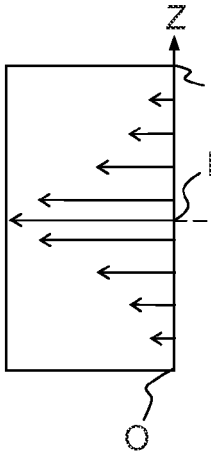
FIG. 3*a* illustrates the variation of electric field in the cavity for the mode $H_{111}$ and FIG. 3*b* for the mode $H_{112}$.
Figure 3B:
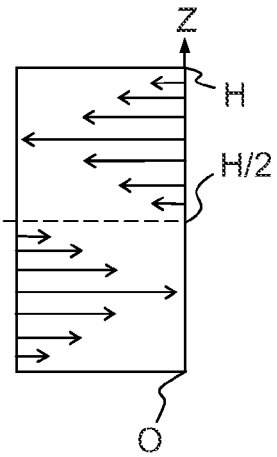

FIG. 3*a* describes by way of illustration the variation of the electric field E in relation to Z in the cavity for the mode $H_{111}$, from abscissa z=0 to abscissa z=H, with a maxima at abscissa z=H/2, and FIG. 3*b* the variation of the electric field E in the cavity for the mode $H_{112}$, from abscissa z=0 to abscissa z=H, with a minima at abscissa z=H/2.

For the invention the presence of a dielectric element in the cavity hardly perturbs the respective Z position of the field minima and maxima with respect to the case of an empty cavity.

Figure 4A:
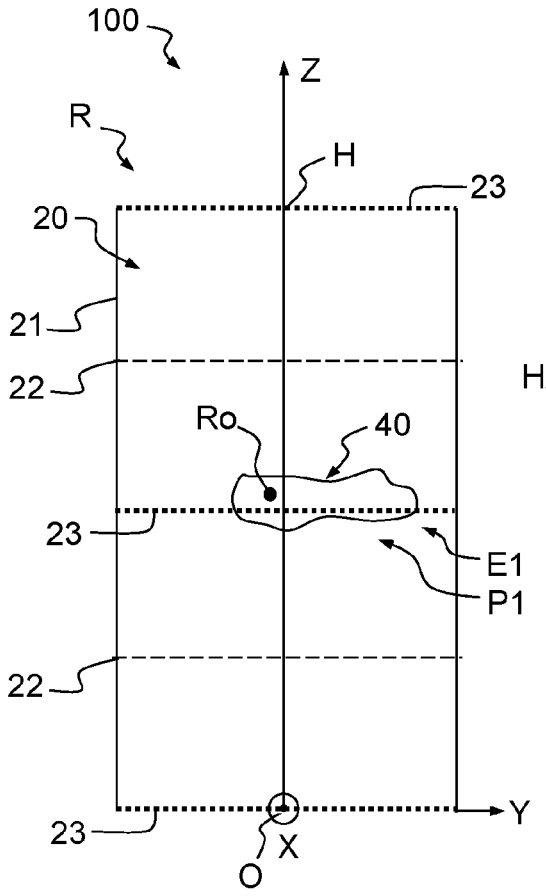
FIGS. 4*a*-4*b* describe an example of the filter according to the invention, FIG. 4*a* in position P1 and FIG. 4*b* in position P2.
Figure 4B:
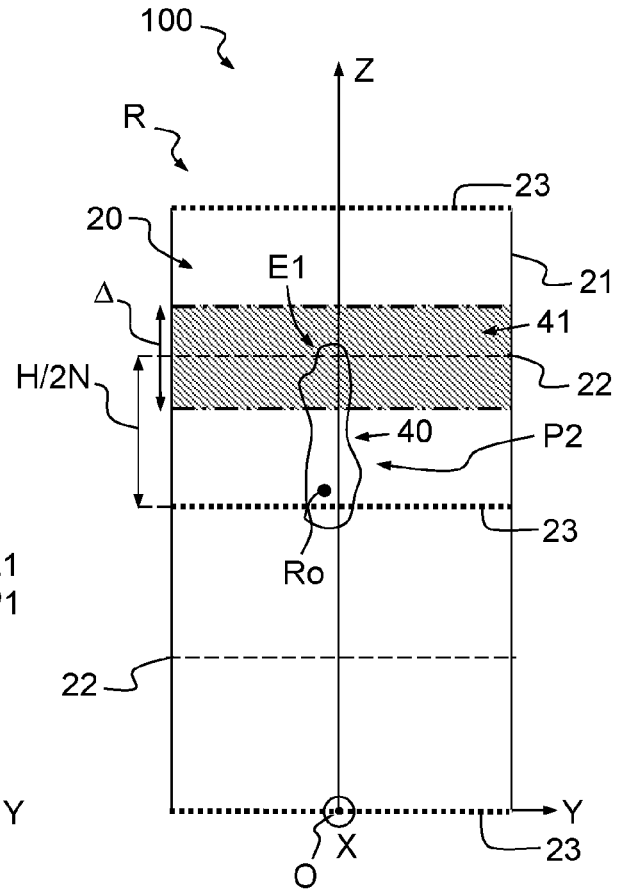

FIGS. 4*a* and 4*b* describes a filter 100 according to the invention according to a cut in a plane YZ, XYZ being an orthonormal coordinate system with an origin O corresponding to an abscissa z=0 for a mode $H_{112}$. Hereinafter the various embodiments of the invention are illustrated for a dual mode $H_{112}$ (N=2) but can of course be adapted for other values of N. Depicted once again are the resonator R, the cavity 20, the metallic wall 21, the minima 23 (short dashed lines) and the maxima 22 (long dashed lines). The filter 100 according to the invention also comprises at least one dielectric element 40 disposed inside the cavity 20 having at least one first end E1. The filter 100 furthermore comprises means of rotation adapted for setting the dielectric element 40 into rotation in relation to an axis of rotation Ro substantially perpendicular to the axis Z, between at least a first position P1 (illustrated in FIG. 4*a*) and a second position P2 (illustrated in FIG. 4*b*).

In the first position P1 the dielectric element 40 is disposed substantially in a plane perpendicular to the axis Z and the centre of first end E1 is disposed at a height in the cavity corresponding substantially to a minimum of the electric field. The expression "centre of the end" is intended to mean the barycentre of the external cross-section of the dielectric element 40.

Thus the whole, or the largest part, of the volume of the dielectric element 40 (typically at least 80% of the volume of the dielectric) is situated in a region where the electric field is weak (typically at +/−40% around the field minima). The dielectric element 40 thus positioned hardly perturbs the cavity, which then operates according to a conventional dual mode of type $H_{11N}$.

Thus the expression "substantially in a plane perpendicular to" and the expression "the centre of the first end is disposed at a height in the cavity corresponding substantially to a minimum of the electric field" ought to be interpreted broadly, that is to say a location at +/−40% of the position of the minimum. Indeed in this position P1 the effect sought is a weak perturbation of the electric field by the dielectric positioned in a zone in which the electric field is weak.

The dielectric element 40 and the cavity 20 are adapted so that the first position P1 corresponds to a geometry of resonator resonating in dual mode according to a first central frequency f1.

In the second position P2, after rotation about the axis R, the dielectric element 40 is substantially parallel to Z and its first end E1 is disposed in a plane corresponding to an electric field maximum to within +/−30%. The zone 41 (FIG. 4*b*) corresponding to the maximum +/−30% is hatched in FIG. 4*b*. Preferably, the first end E1 is situated in the zone in the vicinity of a maximum closest to the minimum in which the dielectric element 40 is situated in the first position P1.

The hatched zone 41 (FIG. 4*b*) has a total width Δ in relation to Z of:

$$\Delta(\text{FIG. } 4b)=(H/2N+30\%)-(H/2N-30\%)=0.6H/2N,$$

centred around a maximum 22.

It is considered that this zone corresponds to a region in which the electric field E has a value significant enough to be perturbed by the dielectric element 40, which in the position P2 has a non-negligible part of its volume inside this zone 41 (FIG. 4*b*).

The perturbation of the field gives rise to a modification of the central frequency of the filter 100. Thus the dielectric element 40 and the cavity 20 are adapted so that the second position P2 corresponds to a geometry of resonator resonating in dual mode according to a second central frequency f2.

The rotation of the dielectric element 40 between at least two positions P1 and P2 makes it possible to modify the central resonant frequency of the filter 100 according to the invention, according to at least two values f1 and f2, this being suitable for applications of "channel jump" type.

Generally, the shape of the dielectric element 40, the position of the axis of rotation Ro and the value of the angle of rotation between the two positions, are optimized to allow the resonance of the resonator R according to a dual mode according to at least two central frequencies f1 and f2, a first frequency f1 corresponding to a cavity mode hardly perturbed by the dielectric element 40 in the position P1, a second frequency f2 corresponding to a cavity mode perturbed by the dielectric element 40 in the position P2.

The dielectric in the position P2 concentrates the electric field, decreasing the resonant frequency. Indeed generally the resonant frequency of a medium is inversely proportional to the square root of the permittivity (relative permittivity $\in r$ equal to 1 for a vacuum; and greater than 1 for a dielectric). Stated otherwise, the electromagnetic wave propagates less quickly in a strongly dielectric medium: for one and the same duration the electromagnetic wave travels less distance in a dielectric than in vacuum for one and the same frequency. Therefore the higher the permittivity, the smaller the system (or for equal dimensions, the lower the frequency).

The cavity of the filter according to the invention is composed of air ($\in r$=1.00) and of dielectric ($\in r$ typically from 10 to 40). Therefore, there exists an effective permittivity lying between the two. This effective permittivity depends on the mode used, and on the position of the dielectric in the cavity. Thus the effective permittivity is lower for the hardly perturbed mode than for the perturbed mode. Indeed, in the second case the dielectric is placed essentially in the zone where the field is strong (in the vicinity of an electric field maximum), it impacts strongly, bringing about a hike in the effective permittivity (hence a decrease in the frequency).

In a conventional use of a filter according to a dual mode, the relative permittivity is constant. A frequency-agile dual filter is conventionally produced by using a movable hood which reduces the volume of the cavity, and therefore increases the resonant frequency.

A filter 100 according to the invention thus presents numerous advantages. The filter is both "dual", with all the associated advantages such as compactness, and tunable. The RF performance is not substantially degraded by the change of frequency, and the quality factor Q is not substantially degraded either. Indeed, there are several origins of the filter losses:

1/ metallic (walls of the cavity, filter losses are higher as the strong field is close to the walls)

2/ dielectric (filter losses are higher as the strong field is located in the dielectric).

In the hardly perturbed state, the field is hardly concentrated in the dielectric and is relatively close to the walls. In the perturbed state, the field is slightly more concentrated, typically around in the dielectric. Therefore in the perturbed state there are more dielectric losses, but the field being attracted by the dielectric, it moves further away from the walls, thereby inducing a decrease in the metallic losses.

The shape of the dielectric is optimized so that the losses are as low as possible in both cases. The variation is in all cases very low compared with solutions using tuning elements such as diodes or MEMS.

Typically a Q factor>10000 is obtained for a filter according to the invention.

Furthermore, the filter has a narrow band (see further on an example of performance as a function of frequency). Moreover, the filter is capable of supporting a microwave signal of high power, typically greater than 150 W. These power withstanding capability levels are totally inconceivable with semi-conducting components or MEMS.

Certain embodiments have the advantage of simplifying the design and the optimization of the filter. In a first example illustrated in FIGS. 5*a*, 5*b*, 5*c*, and 5*d*, the axis of rotation Ro is concurrent with the axis Z, is situated at an abscissa corresponding to an electric field minimum, here H/2 (FIG. 5*a*) is in the preferential mode $H_{112}$, N=2 and is along an axis X corresponding to a polarization axis Px of the dual mode. According to one embodiment, the axis of rotation Ro is perpendicular to the axis Z.

Figure 5A:
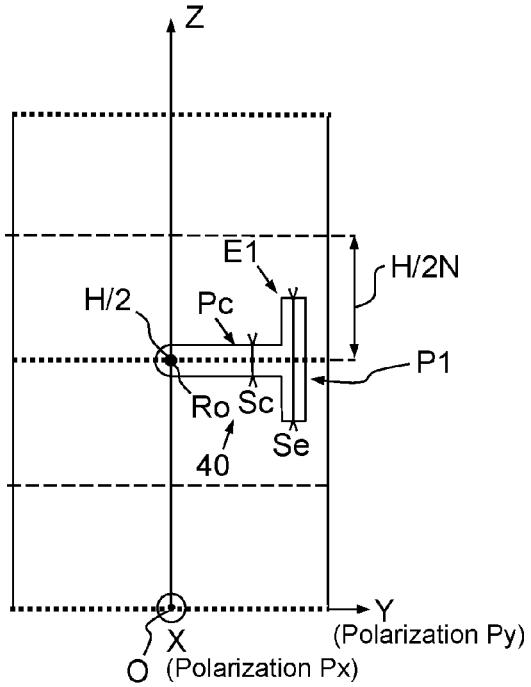
FIGS. 5*a*-5*d* describe a first filter embodiment according to the invention.
Figure 5C:
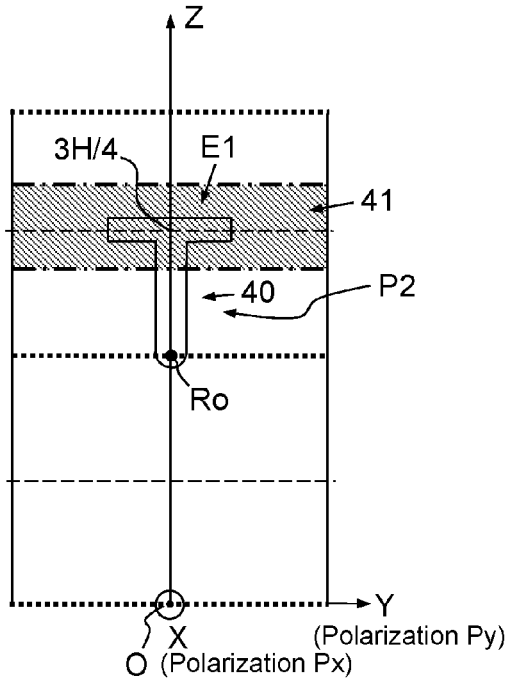
Figure 5B:
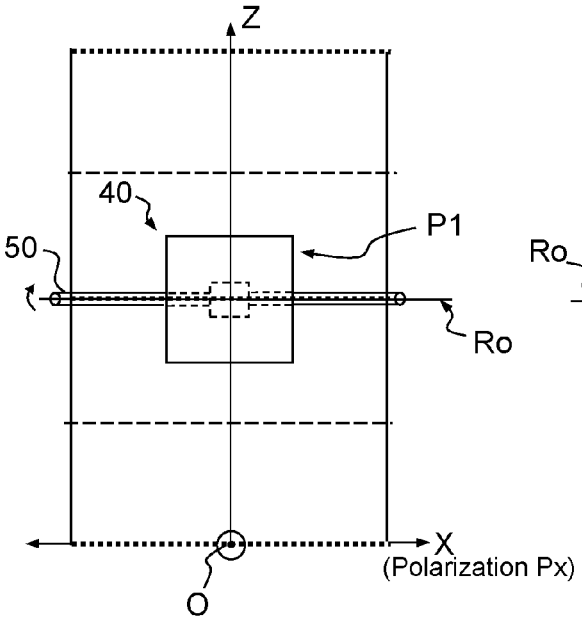
Figure 5D:
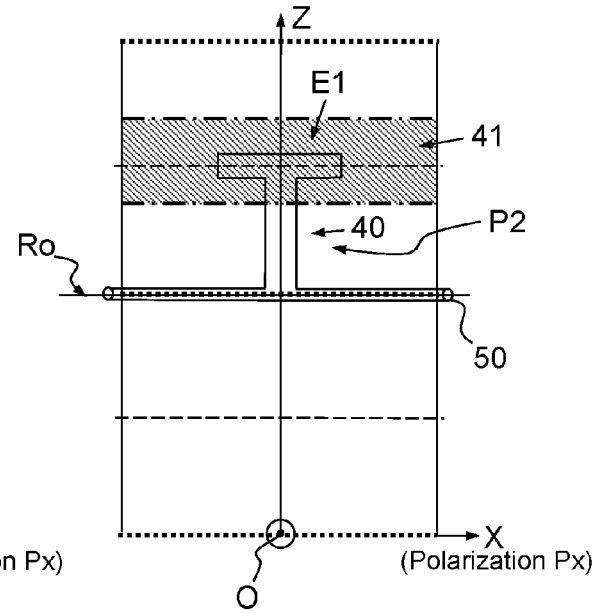

FIGS. 5*a* and 5*b* correspond to the position P1, FIGS. 5*c* and 5*d* correspond to the position P2. FIGS. 5*a* and 5*c* correspond to a cut through the plane YZ, FIGS. 5*b* and 5*d* correspond to a cut through the plane XZ.

According to one embodiment illustrated in FIGS. 5*a*, 5*b*, 5*c*, and 5*d*, the angle of rotation in relation to the axis R between the first position P1 and the second position P2 is substantially equal to 90°.

According to one embodiment illustrated in FIGS. 5*a*, 5*b*, 5*c*, and 5*d*, the means of rotation comprise a rod 50 (serving as linking means) along the axis R rigidly attached to the element and comprising a dielectric material. This rod system makes it possible to reconfigure the filter, either in flight (with the aid for example of a stepper motor controlling the rotation of the rod 50 and therefore of the dielectric element 40), or on the ground (operational flexibility).

According to a preferred mode also illustrated in FIGS. 5*a*, 5*b*, 5*c*, and 5*d* the dielectric element 40 has a central part Pc of elongate shape and at least one end E1 having a greater cross-section Se than a cross-section Sc of the central part Pc. This particular shape of dielectric element makes it possible to maximize the perturbing effect of the dielectric by positioning a maximum of volume, corresponding to the volume of the end E1, in the zone 41 (FIG. 4*b*) at position P2 (as shown in Figured 5*c* and 5*d*).

In the modes $H_{11N}$, the electric field is concentrated in the vicinity of the axis Z. The shape of the dielectric, in order to perturb the field must therefore preferably be optimized so that at position P2 a significant volume of the end of the dielectric is located in the vicinity of the axis Z.

Generally, for proper operation of the filter in dual mode, the dielectric element 40 in the second position P2 has a shape such that the volume traversed by a polarization, for example Px, is substantially identical to the volume traversed by the orthogonal polarization Py. This condition must be complied with for the part of the volume of the dielectric element 40 that is situated in the zone in which the electric field is a maximum, i.e. typically in the zone 41 (FIG. 4*b*), since it is mainly in this zone 41 (FIG. 4*b*) that the electric field is perturbed by the presence of the dielectric element 40.

This condition is achieved for example when the end E1 of the dielectric element 40 in FIG. 4*b* has in the second position a shape such that it is invariant under rotation of 90° about the axis Z.

The square shape of the end E1 of the dielectric element 40 of FIG. 5 has this property.

The elongate central part may if appropriate also have this type of property (for example square or circular elongate part).

Figure 6:
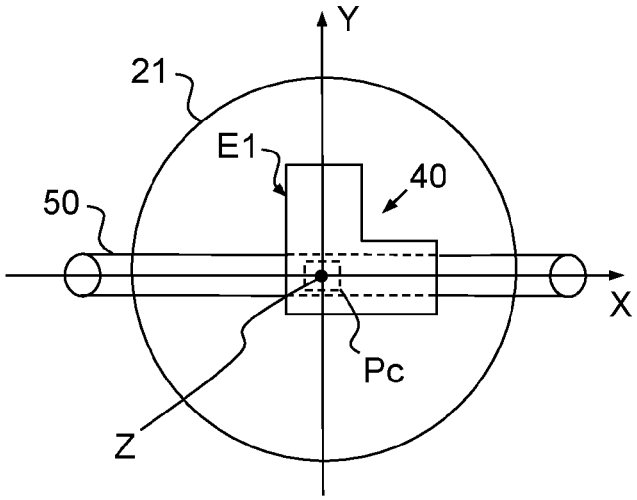
FIG. 6 illustrates an exemplary end shape of the dielectric element of the filter according to the invention.

Likewise an L-shape of the end E1 of the dielectric element 40 illustrated in FIG. 6 (view from above) satisfies this property of invariance under rotation of 90°.

The condition is also achieved when the shape of the dielectric element 40 (for example, shown in FIG. 6) comprises two orthogonal symmetry planes, each symmetry plane coinciding with a plane comprising a polarization axis and the axis Z, when the dielectric element 40 is in the second position P2:

Symmetry planes: PxZ and PyZ, Px and Py axes of polarization of the dual mode (X and Y in FIGS. 5*a*, 5*b*, 5*c*, and 5*d* and 6).

Figure 7:
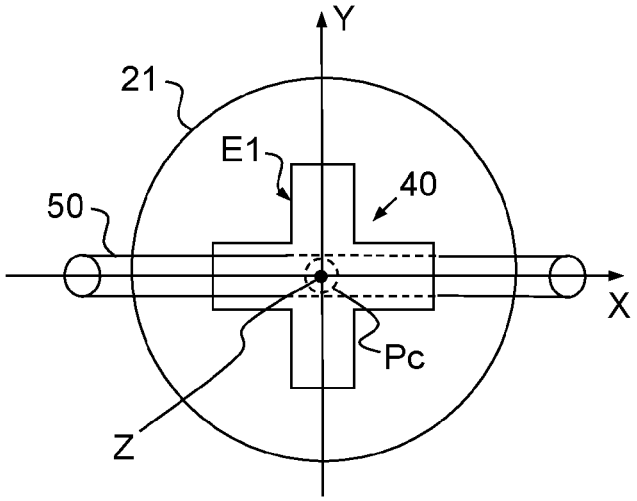
FIG. 7 illustrates another exemplary end shape of the dielectric element of the filter according to the invention.

FIG. 7 illustrates a dielectric element 40 whose end has the shape of a cross (view from above), which has at one and the same time the two orthogonal symmetry planes hereinabove and an invariance under rotation of 90° about Z in the position P2.

Figure 8:
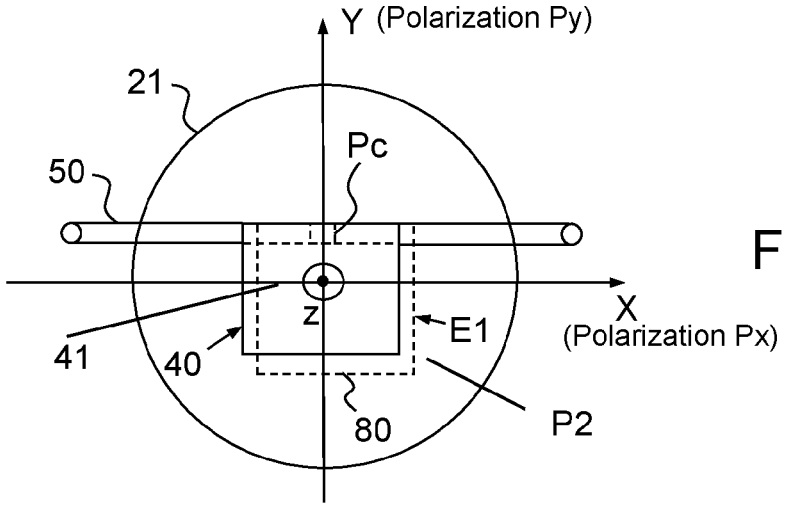
FIG. 8 illustrates another exemplary end shape of the dielectric element of the filter according to the invention.

For reasons related to bulkiness of the filter 100, it may not be possible to position the axis of rotation Ro concurrent with the axis Z, and the axis R is therefore shifted laterally, such as illustrated in FIG. 8. In this case, the dielectric element 40 has a likewise shifted central part Pc. In order to equalize the volume traversed by the two polarizations Px and Py in the second position P2, mainly in the zone 41 (FIG. 4*b*) in which the electric field has a maximum, the end E1 is centred on the axis Z and can have the previous properties with respect to this axis Z.

The previous condition, according to which the dielectric volume traversed, particularly in the zone 41 (FIG. 4*b*), is preferably identical for the two polarizations. A slight dissymmetry may be introduced, for example by shifting and modifying the initial square shape into a rectangle, such as illustrated by dashes 80 in FIG. 8. This dissymmetry makes it possible, in combination with or in replacement for the metallic screws at 45°, to mutually couple the polarizations. Typically a modification of the dimensions of the order of 1% to 5% is able to achieve the coupling. This dissymmetrization of the volume of the element in the zone 41 (FIG. 4*b*) is of course compatible with any shape of dielectric element 40.

Figure 9A:
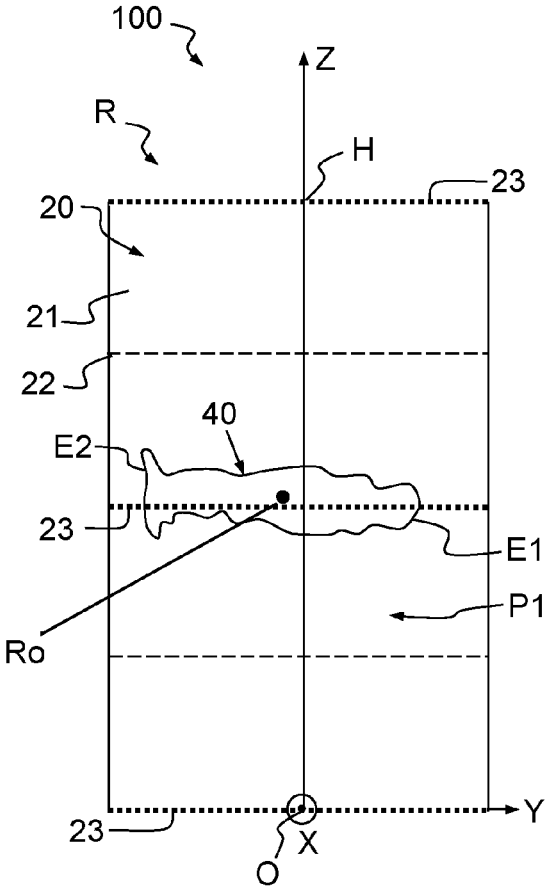
FIGS. 9*a*-9*b* illustrate a second example of the filter according to the invention, FIG. 9*a* in position P1 and FIG. 9*b* in position P2.
Figure 9B:
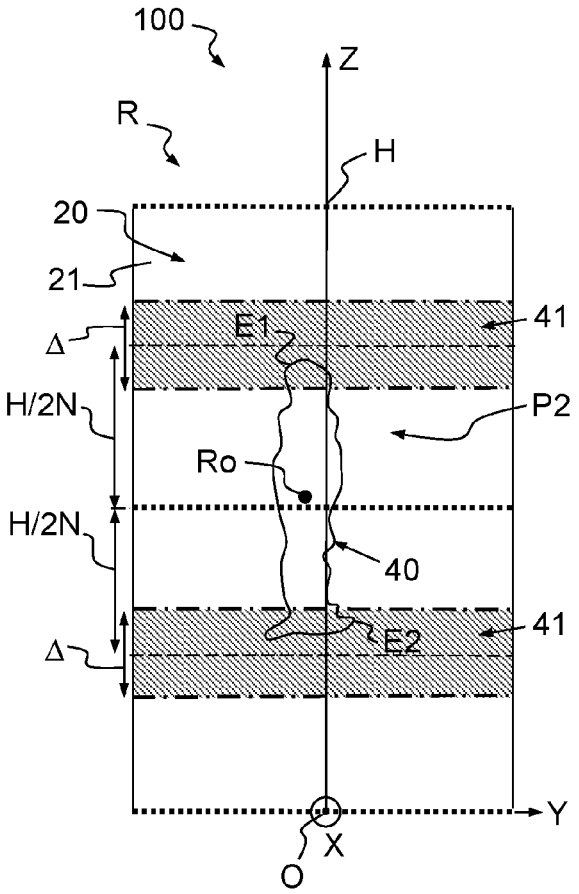

According to a second example illustrated in FIGS. 9*a* and 9*b* (first position P1, FIG. 9*a*, and second position P2, FIG. 9*b*) the dielectric element 40 comprises a second end E2 so that in the first position P1 the centre of the second end E2 is disposed at a height in the cavity corresponding substantially to a minimum of the electric field, in the second position P2 the second end E2 is disposed in a plane corresponding to an electric field maximum to within +/−30%.

In this embodiment each of the ends perturbs the electric field in the position P2. Each end is situated in a zone 41 corresponding to a height along the abscissa z equal to the Δ defined previously as shown in FIG. 9*b*. This embodiment has the advantage of producing a more significant perturbation than with a single end, thereby allowing a more significant excursion in terms of central frequency and making it possible to retain a symmetric structure with respect to the centre of the cavity.

A variant of this embodiment is described in FIGS. 10*a* and 10*b* (FIG. 10*a* for the position P1 and FIG. 10*b* for the position P2). The axis R is concurrent with Z, and the dielectric element 40 has an elongate central part whose axis is situated in the plane perpendicular to Z corresponding to an electric field minimum, here of abscissa z=H/2 in position P1, and a symmetry with respect to this plane. The end E1 has an upper cross-section and is of square shape for example. In the position P2, a dielectric element is thus obtained which strongly perturbs the electric field, with a significant part of the volume of the dielectric element 40 in a zone 41 (FIG. 4*b*), the volume of the dielectric being more concentrated in the vicinity of Z in a concentration zone 90 as shown in FIG. 10*b*.

FIGS. 11*a* and 11*b* illustrates a view from above of the electric field, showing diagrammatically the variation of the field in section in the vicinity of a maximum. FIG. 11*a* corresponds to the polarization Px (along X) and FIG. 11*b* to the polarization Py (along Y). Each polarization is a maximum along its axis, and at the centre of the cavity, and decreases on approaching the circular wall. The distribution of the field corresponding to one polarization is deduced from the distribution of the field corresponding to the other polarization by a 90° rotation about Z.

Figure 12A:
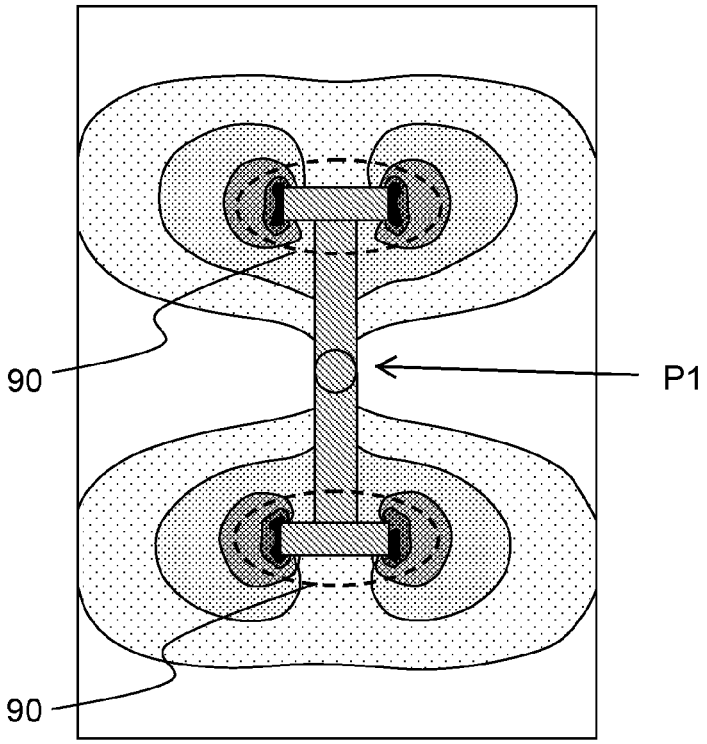
FIGS. 12*a*-12*b* represent the values of the electric field in the cavity, FIG. 12*a* with the dielectric in position P1 and FIG. 12*b* with the dielectric in position P2.
Figure 12B:
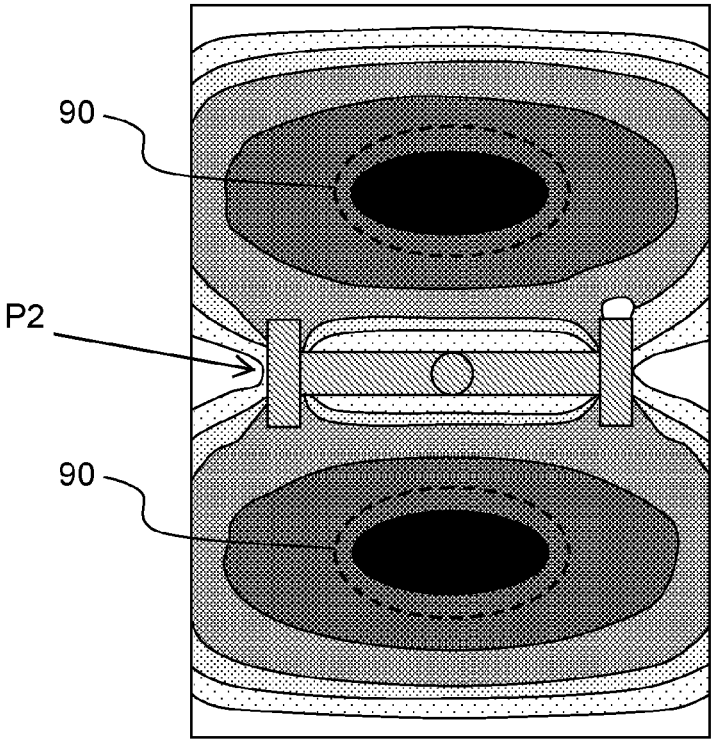

FIGS. 12*a* and 12*b* represents the values of the electric field in the cavity for the dielectric in position P1 (FIG. 12*a*) and in position P2 (FIG. 12*b*) for a polarization. The maximum field values are concentrated in the concentration zone 90.

Figure 13A:
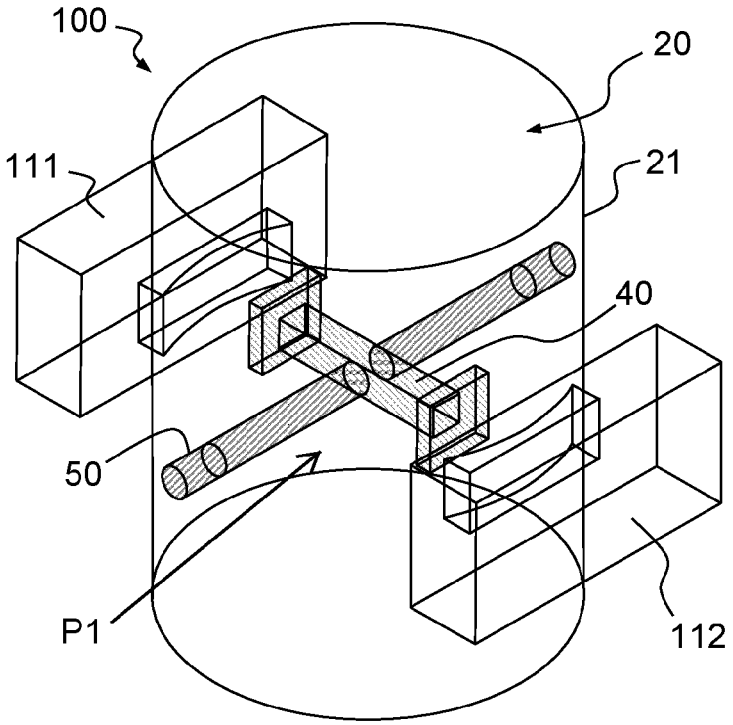
FIGS. 13*a*-13*b* illustrate a filter according to the invention seen in perspective.
Figure 13B:
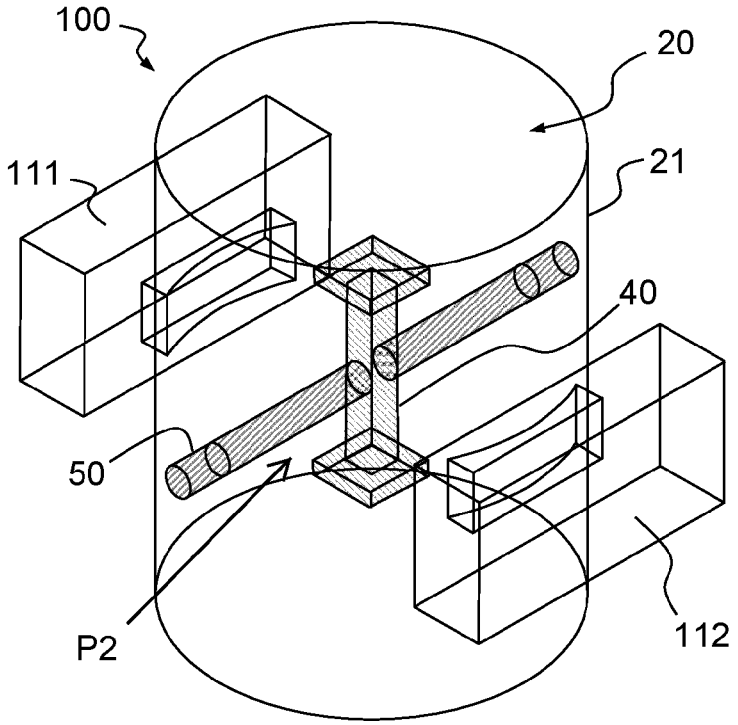

FIGS. 13*a* and 13*b* illustrates a filter 100 according to the invention seen in perspective (FIG. 13*a* position P1 and FIG. 13*b* position P2), showing diagrammatically the maximum field zones. The filter has conventional means of input 111 and of output 112 allowing the microwave-frequency wave respectively to enter and to exit the filter, respectively. The wall has a director curve (base) that is circular. Here the coupling is lateral, but the filter according to the invention is of course compatible with a coupling through the bottom.

As a variant, the filter 100 comprises a plurality of resonators and coupling means adapted for coupling together two consecutive resonators.

Figure 14A:
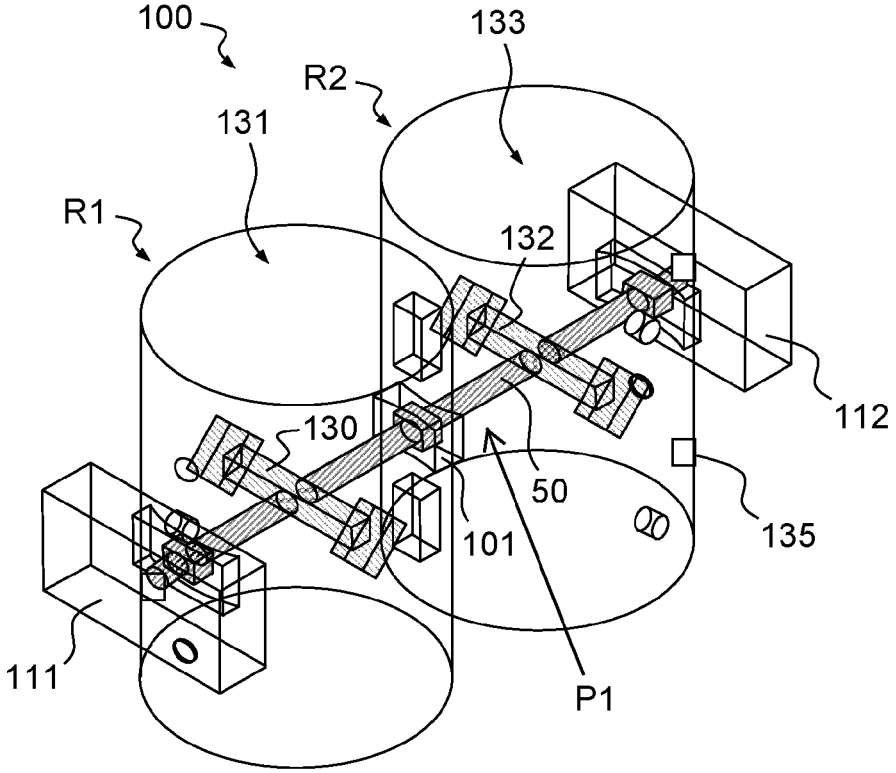
FIGS. 14*a*-14*b* illustrate a filter according to the invention comprising a plurality of resonators and seen in perspective.
Figure 14B:
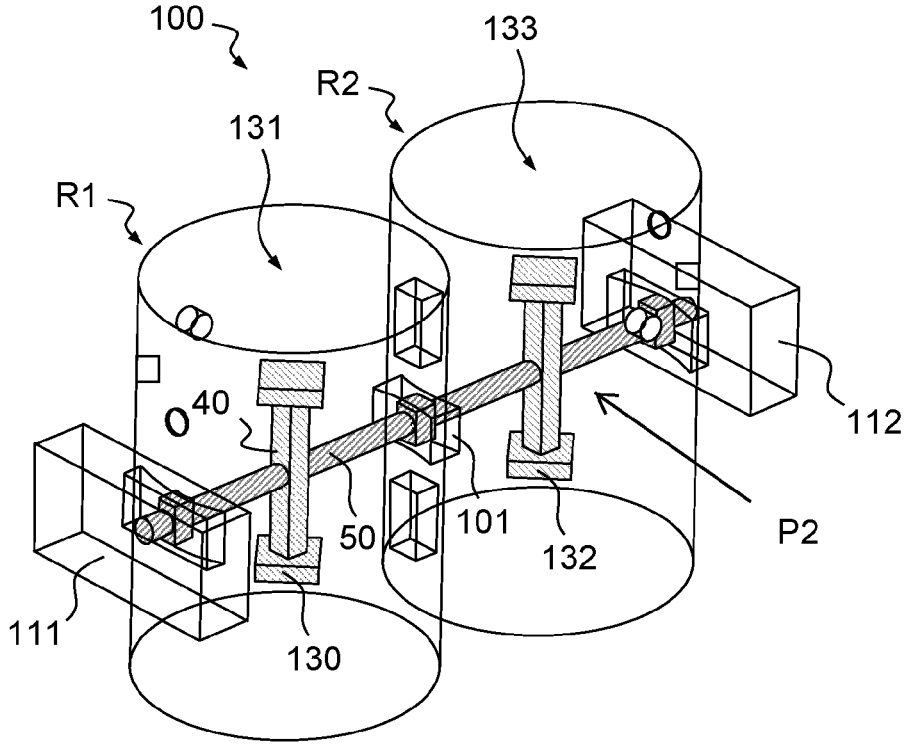

FIGS. 14*a* and 14*b* (FIG. 14*a* position P1, FIG. 14*b* position P2) illustrate a filter 100 comprising two resonators R1 and R2 each comprising a cavity 131 and 133, and a dielectric element 130, 132, the resonators being coupled together with the aid of a coupling means 101, here an iris. Means of input 111 and of output 112 allow the microwave-frequency wave respectively to enter and to exit the filter. Metallic screws 135 (FIG. 14*a*) contribute to the mutual coupling of the polarizations.

Each resonator comprises a cylindrical wall and the coupling is lateral. The successive dielectric elements 130 and 132 are aligned along one and the same axis and are rigidly attached to one and the same rod 50. This geometry has the advantage of allowing the control of the whole set of rotations of the plurality of element with one and the same element, the rod 50.

Thus as a variant the filter according to the invention furthermore comprises linking means for equalizing the respective rotations of the means of rotation of the dielectric elements. Advantageously, the linking means comprise the rod 50 rigidly attached to a plurality of elements 130, 132 disposed along the rod 50.

The filter 100 of FIGS. 14*a*, 14*b* comprises two cavities, each resonating on two polarizations, and thus constitutes a so-called "4-pole" filter.

The invention is of course compatible with 3 (or more) cavities, making it possible to obtain a narrower passband.

According to a variant, additional dielectric elements, disposed inside the coupling means 101 between the cavities, are inserted. These additional dielectric elements are rigidly attached to the linking means, for example the rod 50, so that they perform a rotation identical to that of the dielectric elements 130 and 132. They furthermore have a shape adapted so as to guarantee optimal mutual coupling of the resonators for the two positions P1 and P2 of the dielectric elements 130, 132.

As a variant, when the axis of rotation Ro passes inside the input 111 and output 112 means, additional dielectric elements are disposed inside these means 111 and 112.

Figure 15A:
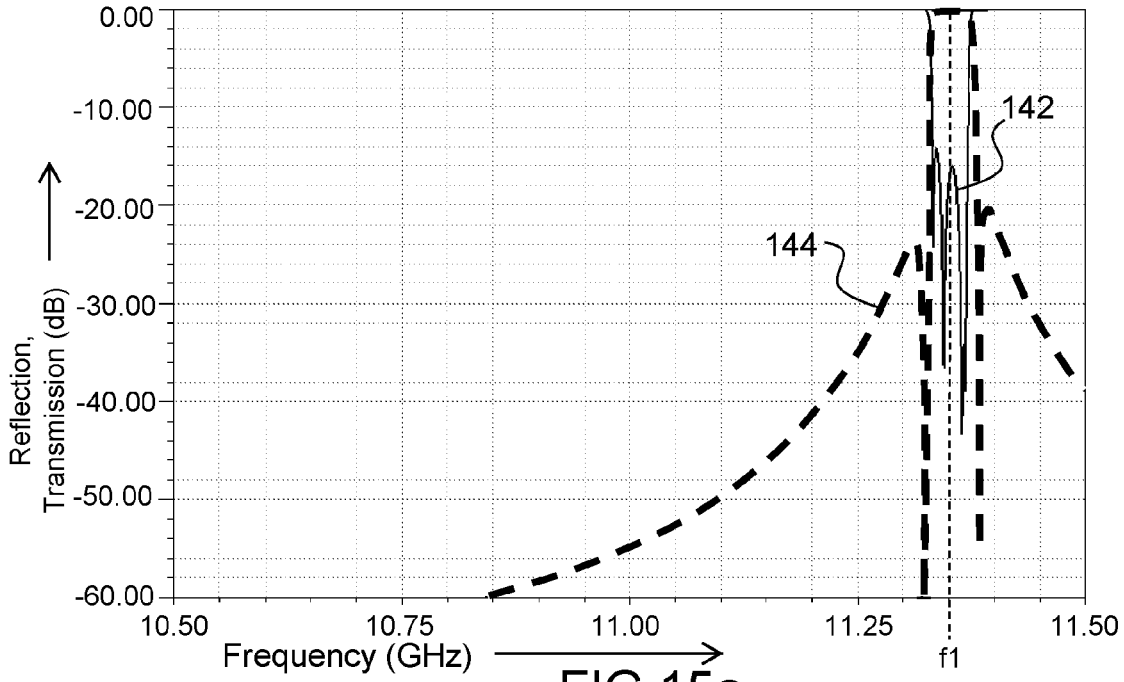
FIGS. 15*a*-15*b* illustrate an example of frequency behaviour of a filter according to the invention, FIG. 15*a* in position P1 and FIG. 15*b* in position P2.
Figure 15B:
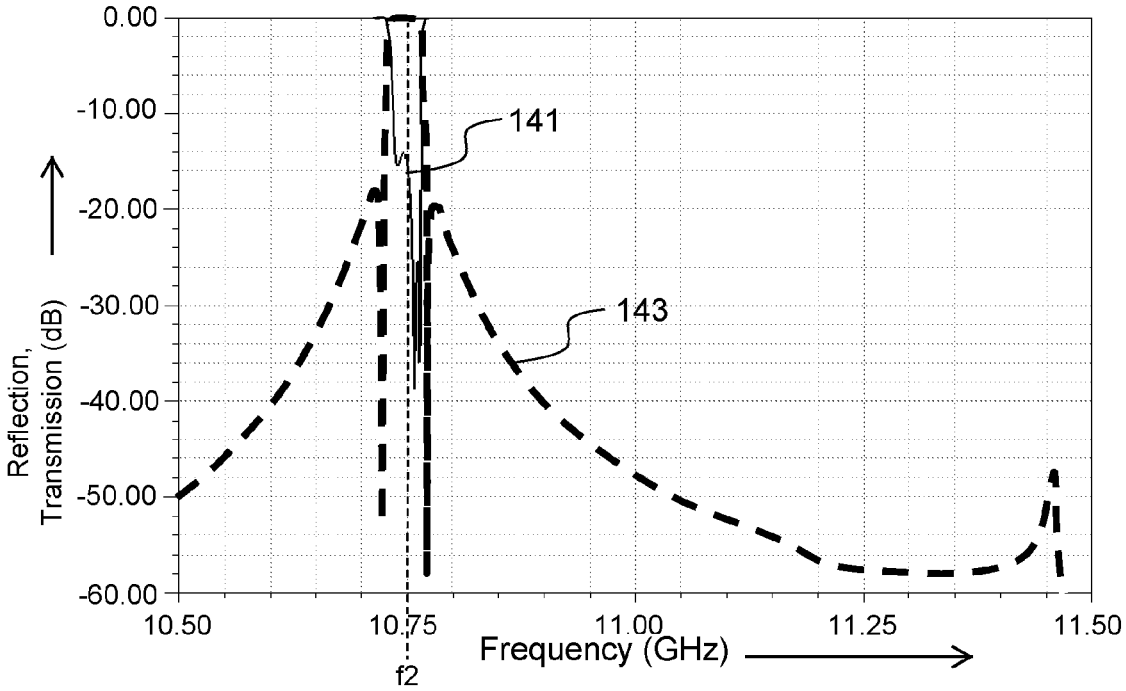

An example of frequency behaviour of the filter of FIG. 14 is illustrated in FIGS. 15*a* and 15*b* (FIG. 15*a* position P1, FIG. 15*b* position P2). The dual mode is of type $H_{112}$ and the parameters of the filter of this example are:

Height H: 35 mm; diameter of the cylinder 25 mm; dielectric element made of BMT (permittivity 24.7) of elongate shape, dimension of the square end: side 4.8 mm×4.9 mm and thickness 1.5 mm.

The curves 141 (FIG. 15*b*) and 142 (solid line, FIG. 15*a*) corresponds to the curves of type S11 (reflection of the filter in dB) and the curves 143 (FIG. 15*b*) and 144 (dashed line, FIG. 15*a*) to the curves of type S21 (transmission of the filter in dB). Between the two positions P1 (f1=11350 MHz) and P2 (f2=10750 MHz), a variation of about 600 MHz (6.5% of the resonant frequency) is noted. FIGS. 15*a* and 15*b* each show reflection and transmission (in dB) along the respective vertical axes and frequency (in GHz) along the respective horizontal axes.

The means of rotation can also comprise a stepper motor to control the rotation of the dielectric elements, in the case where a reconfiguration of the filter must be performed in flight for example.

Figure 16:
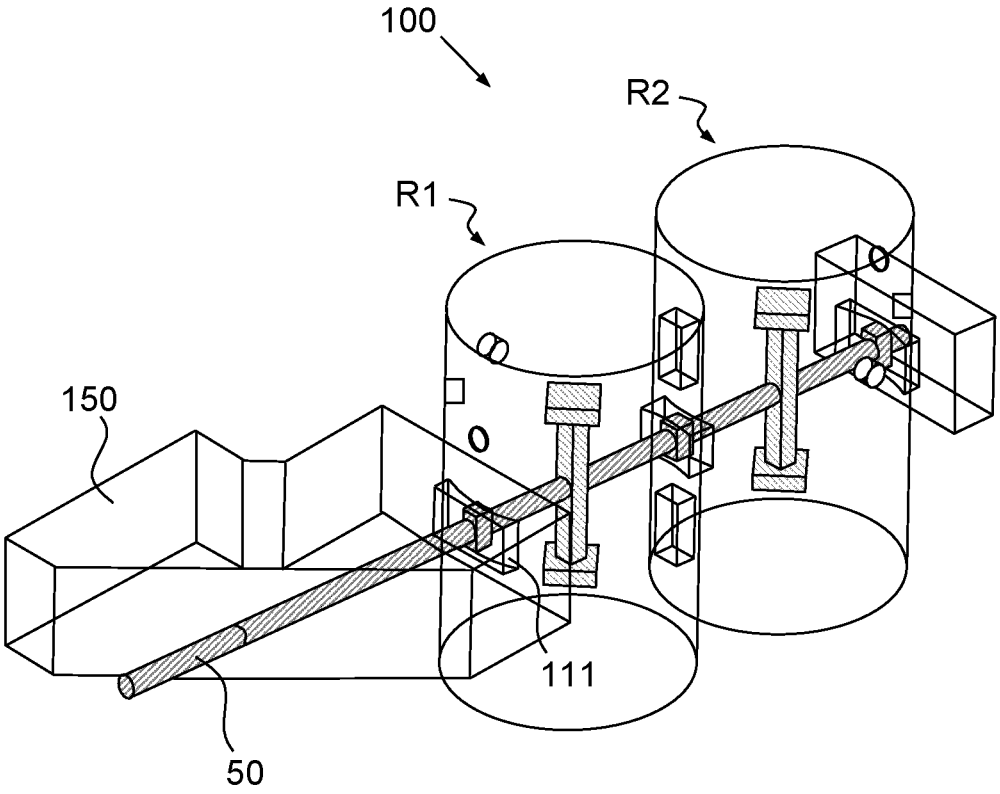
FIG. 16 illustrates a filter variant according to the invention.

FIG. 16 describes a variant of the invention according to which a bent waveguide 150 is coupled to the input means 111 to allow both the interception of the microwave-frequency wave and the exit of the rod 50 of the filter 100. The waveguide 150 is drilled with a hole allowing the rod 50 to exit so as to be controlled in rotation, by a stepper motor, for example.

According to another aspect, the subject of the invention is a microwave circuit comprising at least one filter 100 according to the invention.

The invention claimed is:

1. A bandpass dual mode filter for microwave-frequency wave, the bandpass dual mode filter being frequency tunable, the bandpass dual mode filter comprising:

at least one resonator, each said at least one resonator including:

a cavity having a conducting wall substantially cylindrical in relation to an axis Z having a height H, a position along the axis Z being labelled by an abscissa z lying between 0 and H, the cavity being at least partially closed at two ends, and a dielectric element disposed inside the cavity;

said at least one resonator resonating according to a mode for which two perpendicular polarizations respectively have distributions of the electromagnetic field in the respective cavity, said distributions of the two perpendicular polarizations being obtained from one another by a rotation of the respective dielectric element by 90° around an axis of symmetry of the at least one resonator;

said mode having in said respective cavity N maxima and N+1 minima of the electromagnetic field, N being an integer, said N maxima and N+1 minima are situated substantially in a plane perpendicular to the axis Z, the two ends of the respective substantially cylindrical conducting wall at the abscissae z=0 and z=H corresponding to respective electromagnetic field minima, successive minima and maxima in the N maxima and N+1 minima being spaced apart by a separation distance H/2N;

the at least one resonator further including:

means of rotation adapted for setting each said dielectric element into rotation in relation to an axis Ro substantially perpendicular to the axis Z, between at least a first and a second position;

each said dielectric element comprising at least one first end such that:

in a first position, each said dielectric element is disposed substantially in a plane perpendicular to the axis Z and a center of said at least one first end is disposed at a height in the cavity corresponding substantially to a minimum of the electromagnetic field, in a second position, each said dielectric element is substantially parallel to the axis Z and said first end is disposed in a plane corresponding to an maximum of the electromagnetic field to within +/−30%.

2. The bandpass dual mode filter according to claim 1, in which each said dielectric element has a central part of an elongated shape and a first end having a greater cross-section than a cross-section of the central part.

3. The bandpass dual mode filter according to claim 1, in which each said dielectric element in the second position has a shape such that a volume traversed by the electromagnetic field in a polarization is substantially identical to a volume traversed by the electromagnetic field in an orthogonal polarization.

4. The bandpass dual mode filter according to claim 1, in which each said dielectric element in the second position has a shape that is invariant under a rotation of 90° about the axis Z.

5. The bandpass dual mode filter according to claim 1, in which a shape of each said dielectric element comprises two orthogonal symmetry planes, a symmetry plane in the two orthogonal symmetry planes coinciding with a plane comprising a polarization axis and the axis Z when each said dielectric element is in the second position.

6. The bandpass dual mode filter according to claim 1, in which each said dielectric element comprises a second end such that:

in the first position, a center of the said second end is disposed at a height in the cavity corresponding substantially to a minimum of the electromagnetic field, in the second position, the second end is disposed in a plane corresponding to a maximum of the electromagnetic field to within +/−30%.

7. The bandpass dual mode filter according to claim 1, in which said respective substantially cylindrical wall has a base chosen from among a circle and a square.

8. The bandpass dual mode filter according to claim 1, in which an angle of rotation, relative to an axis of rotation Ro of each said dielectric element, between the first position and the second position is substantially equal to 90°.

9. The bandpass dual mode filter according to claim 1, in which an axis of rotation Ro of each said dielectric element coincides with the axis Z.

10. The bandpass dual mode filter according to claim 1, in which an axis of rotation Ro of each said dielectric element is situated at the abscissa z corresponding to a minimum of the electromagnetic field.

11. The bandpass dual mode filter according to claim 1, in which the means of rotation include a rod along an axis of rotation Ro of each said dielectric element, said rod being rigidly attached to each said dielectric element and comprising a dielectric material.

12. The bandpass dual mode filter according to claim 1, in which N=2.

13. The bandpass dual mode filter according to claim 1, comprising a plurality of resonators and coupling means adapted for coupling together two consecutive resonators.

14. The bandpass dual mode filter according to claim 13, further comprising linking means adapted for making all respective angles of rotation associated with the means of rotation equal.

15. The bandpass dual mode filter according to claim 14, wherein the means of rotation include a rod along the axis of rotation Ro rigidly attached to each said dielectric element, and wherein the linking means comprise the rod rigidly attached to a plurality of dielectric elements disposed along the rod.

16. The bandpass dual mode filter according to claim 14, further comprising additional dielectric elements disposed inside the coupling means and rigidly attached to the linking means.

17. A microwave circuit comprising at least one bandpass dual mode filter according to claim 1.

* * * * *